US006149453A

United States Patent [19]

Hollesen et al.

[11] Patent Number: 6,149,453

[45] Date of Patent: Nov. 21, 2000

[54] IDC SOCKET STRAIN RELIEF CAP REWORK TOOL

[76] Inventors: David B. Hollesen, 365 Homestead Blvd., Belle Mead, N.J. 08502; Ivan Pawlenko, 1242 Old Jordan Rd., Holland, Pa. 18966; Thelma E. Cole, 513 Whiton Rd., Neshamic Station, N.J. 08853; Jason A. Kay, 41 Mr. Kemble Ave., Unit #203, Morristown, N.J. 07960-5118; David S. Kerr, 35 Gunther St., Mendham, N.J. 07945

[21] Appl. No.: 09/483,298

[22] Filed: Jan. 14, 2000

[51] Int. Cl.[7] ..... H01R 4/24

[52] U.S. Cl. ..... 439/395; 29/683

[58] Field of Search ..... 29/861, 863, 754, 29/750, 748, 865, 866; 439/459, 892, 395, 400, 521, 441, 827

[56] References Cited

U.S. PATENT DOCUMENTS 5,961,342 10/1999 Daoud ..... 439/403

5,984,735 11/1999 Daoud ..... 439/733

*Primary Examiner*—Brian Sircus

*Assistant Examiner*—Phuong K T Dinh

*Attorney, Agent, or Firm*—Woodbridge & Associates, P.C.; Richard C. Woodbridge

[57] ABSTRACT

A tool to remove an insulation displacement contact (IDC) strain relief cap that interconnects a wire with an electrical contact. The electrical contact has a bifurcated end to engage and retain a wire and is engageable with the strain relief cap to secure The wire. Means in the form of tabs are provided on the electrical contact to releaseably retain the electrical contact and the strain relief cap together with the wire whereby the electrical contact, wire, and strain relief cap may be moved as a single unit. The tool has tangs to engage the tabs and move them out of engagement with the relief cap while gripping the relief cap for removal from the electrical contact.

4 Claims, 4 Drawing Sheets

IDC SOCKET STRAIN RELIEF CAP REWORK TOOL

BACKGROUND OF THE INVENTION

1.Field of the Invention

This invention relates to an electrical connector for insulation displacement contact (IDC) with insulation conducting wire. The invention finds particular utility in telecommunications where wires terminate in central office and building entrances.

2. Description of Prior Art

It is common to find the use of insulation displacement contact (IDC) technology in the electrical connector industry, because it allows rapid and simple connection of conducting wires to terminals without stripping nor crimping. A typical IDC connection is made by disposing an insulated conducting wire perpendicular to a planar wall portion comprising an IDC slot, stuffing a wire into the slot such that edges thereof cut through the insulation and make electrical contact with conducting strands of a wire. The IDC slots are generally formed by opposed edges of the sheet metal wall portion which is necessarily of a certain width to have sufficient strength to support the contact pressure against the edges.

Commercially available connectors that utilize insulation displacement contact (IDC) technology provide strain relief for multiple conductors. IDC pins are molded into the connector body which is used to support the strain relief member. These commercially available connectors are designed to terminate multiple conductors in a single connector. Strained relief for these types of connectors are designed as an intregal part of the connector body securing all conductors within a single strain relief member. Although this technology finds particular applicability when multiple wires are to be connected and unconnected, it does not lend itself to large pin array connectors where individual wires need to be reworked or rerouted without jeopardizing adjacent connections. Strain relief of the individual contacts or pins provide a great benefit during reworking or rerouting of individual wires.

SUMMARY OF THE INVENTION

It is a primary object of the present invention to provide strain relief for individual IDC pins or contacts.

It is another object of the invention to provide individual strain relief pins that make IDC a viable technology for large pin array connectors.

A further object of the invention is to provide strain relief for individual pins or contacts to allow for automated assembly and easy removal of large pin arrays.

Yet a further object of the invention is to provide strain relief for individual IDC connections to ensure robust electrical connections, while allowing wiring changes and repairs without compromising adjacent electrical connections.

It is a more specific object of the invention to provide an instrument to remove strain relief caps for individual IDC pins or contacts to replace wire wrap technology on current products.

The foregoing objects have been accomplished by providing an instrument to remove IDC strain relief caps that operates in conjunction with an IDC contact to retain an insulated wire rigidly in contact with the cap and contact.

DETAILED DESCRIPTION OF THE INVENTION

Figure 1:
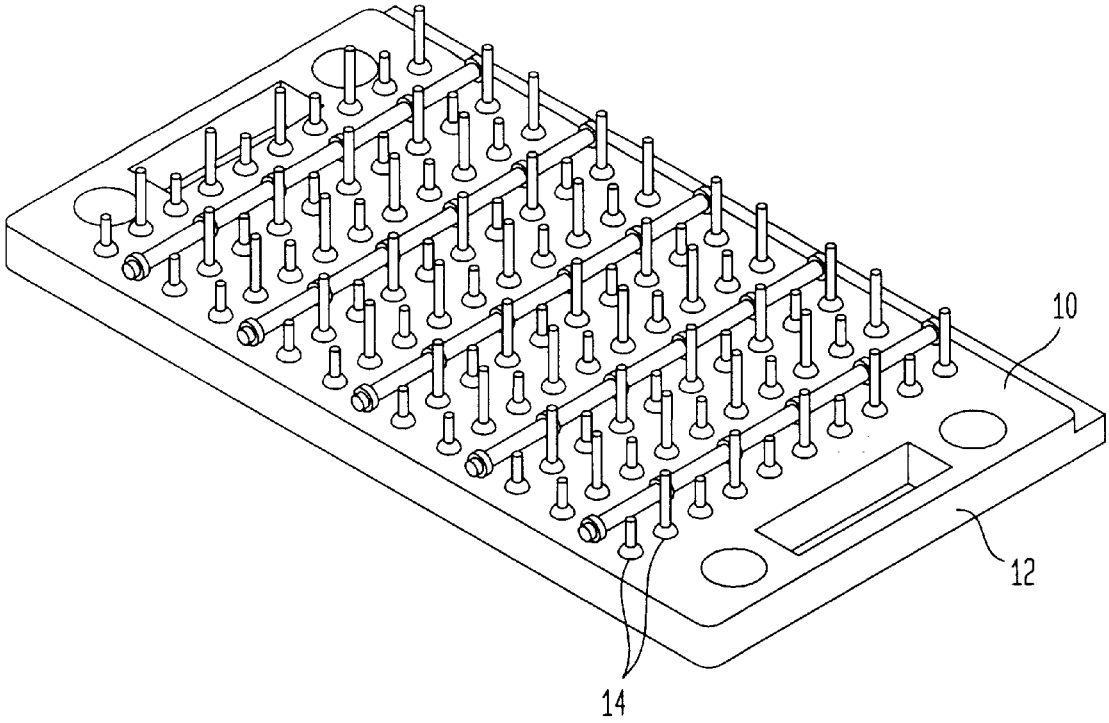
FIG. 1 is an isometric back view of a current projection block having wire wrap pins.
Figure 2:
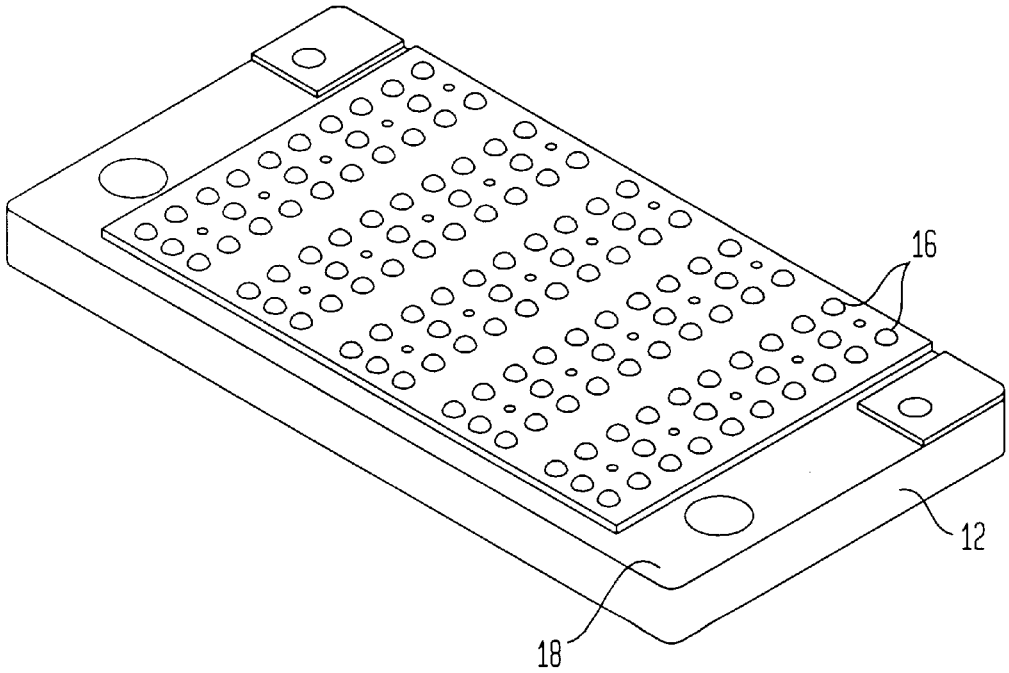
FIG. 2 is an isometric front view of a current projection block having wire wrap pins.

FIG. 1. Illustrates the back 10 of a relatively standard protection block 12 with wire wrap pins 14 projecting through cylindrical openings 16 (FIG. 2) on the front 18 of block 12. In the prior art, wire not shown, is wrapped in a spiral fashion around the pins 14 to provide contact. As described later in the specification, the disclosure of the present invention can make use of protection block 12.

Figure 3:
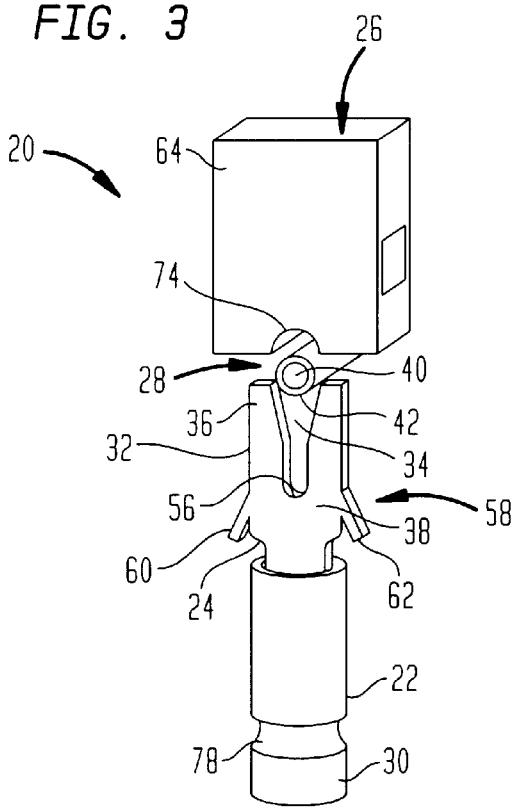
FIG. 3 is an exploded view of an IDC connection.

FIG. 3 illustrates an IDC pin and strain relief cap assembly 20 having an IDC contact 22 terminating at one end in a retainer clip 24 that is engageable with a strain relief cap 26 to retain a wire 28. IDC contact 22 includes a cylindrical hollow body portion 30 having a significant length to engage and be retained by a pin 14 on protection block 12. Opposite from body portion 30 of IDC contact 22, retaining clip 24 includes a bifurcated end 32 having a slot 34 defined by a pair of arms 36 and 38 to grasp and retain wire 28. Wire 28 is of a type commonly used to transmit electricity or signals and includes a center portion 40 made, for example, of solid copper that is surrounded by appropriate insulation 42 to protect center portion 40 from the exterior environment.

Figure 4:
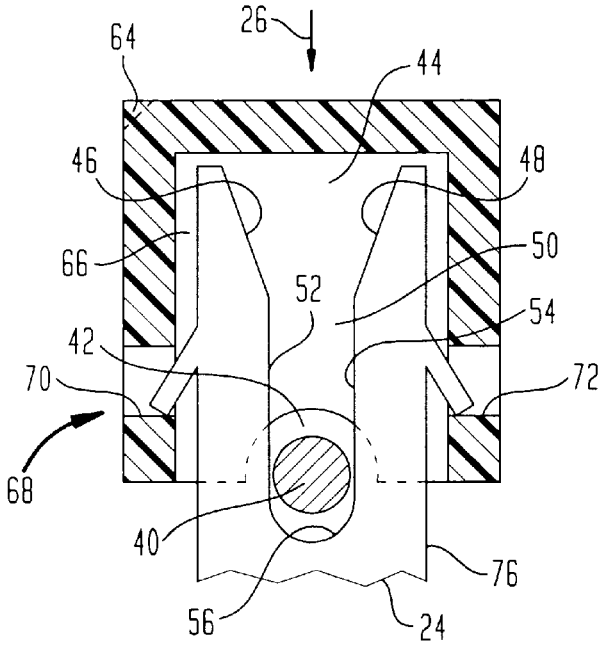
FIG. 4 is an enlarged sectional view of a portion of the IDC connection of FIG. 3.

As depicted in FIG. 4, slot 34 of bifurcated end 32 is defined by an entry section 44 having a pair of angled surfaces 46 and 48 terminating at an end portion 50 defined by parallel sides 52 and 54 and a curved end 56. Parallel sides 52 and 54 are spaced a distance apart that is slightly less than the diameter of center portion 40 of wire 28. Curved end 56 is of a shape to conform to a portion of the wire 28. In assembly the wire moves into bifurcated end 32 between arms 36 and 38, by angled surfaces 46 and 48 into end portion 50 whereby parallel sides 52 and 54 cut through the insulation 42 of wire 28 thereby making contact with center portion 40 of wire 28. The wire is moved in a direction until contact is made between wire 28 and end portion 56 of bifurcated end 32 of IDC contact 22.

IDC contact 22 is preferably made of a standard metal material such as a steel alloy coated with brass to transmit electrical signals or electricity to the pins 14. In the preferred embodiment, retaining means 58 comprises retaining tabs 60 and 62 connected to arms 36 and 38 of bifurcated end 32, which tabs are in flexible and extend outwardly at an angle as shown in FIGS. 3 and 4. These retaining means 58 will be discussed in greater detail in reference to assembly of strained relief cap 26 with IDC contact 22 of assembly 20.

Strain relief cap 26 includes a body portion 64 defining a cavity 66 to receive bifurcated end 32 of IDC contact 22.

Body portion 64 includes gripping means 68 illustrated as a pair of locking windows 70 and 72 oppositely spaced on body portion 64 to receive and retain retaining clips 60 and 62 when bifurcated end 32 is located within cavity 66. A groove 74 extends along body portion 64 and is configured to conform to the exterior surface of wire 28 around insulation 42. Groove 74 is centrally located at the open end 76 of body portion 64.

In assembly, IDC contact is engaged with a pin 14 extending outwardly from a block 12. The end of a wire 28 is located within bifurcated end 32 a distance to ensure contact of the wire across the entire length of groove 74 of strain relief cap 26. The wire is moved downwardly between angled surfaces 46 and 48 to a position in contact with parallel sides 52 and 54. Strain relief cap 26 is then located over bifurcated end 32, with bifurcated end 32 within cavity 66. Cap 26 is pushed toward IDC contact 22 forcing wire 28 into end portion 50 and removing through a cutting or shearing action insulation 42 away from wire 28 as the wire moves into contact with end portion 50. Insulation 42 of wire 28 makes contact with curved end 56 in a preferred embodiment of the invention during fall engagement of cap 26 with contact 22. At this contact point, retaining clips 60 and 62 project outwardly through locking window 70 and 72 of body portion 64 rigidly retaining body portion 64 to contact 22 to complete assembly 20.

Tabs 60 and 62 can be of any known construction and can be apart of arms 36 and 38. As illustrated the side walls of cavity 66 must be spaced a sufficient distance away from the confronting side walls of arm 36 and 38 to allow tabs 60 and 62 to compress inwardly during insertion of bifurcated end 32 within cavity 66 without affecting their flexibility to extend outwardly into windows 70 and 72 at the terminal portion of cap 26 to contact 22. It is significant that at this terminal portion as illustrated in FIG. 4 the cap 26 and contact 22 rigidly retain wire 28. The material of the components is chosen by those skilled in the art to accomplish the desired objectives.

Appropriate means not illustrated, can also be provided to move tabs 60 and 62 inwardly to release cap 26 from contact 22 when it is desired to charge wires. Further, end 30 of contact 22 is constructed in a known manner to be engaged with or disengaged from a pin 14 in a rapid manner when it is necessary to change contact points for the wires 28 relative to the pins 14 on block 12. Retention means in the form of an annular indentation 78 on end 30 can be used for this purpose.

The cap 26 is also so constructed to allow for automated assembly of assembly 20 with pins 14. To this end it is desirable to have the surfaces of bifurcated end 32 when in assembly with cap 26 relatively close to the surfaces defining cavity 66.

The detailed description of the invention up to this point is identical to that of copending application COLE 1-2-32-52-21 mailed to the USPTO on Nov. 17, 1999 and assigned to the assignee of this disclosure.

Figure 5:
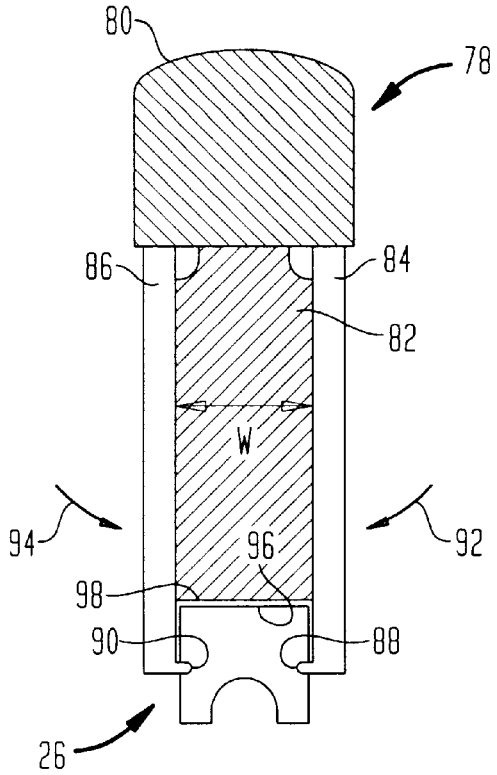
FIG. 5 is a side elevational view of an IDC cap removal tool illustrating removal of an IDC cap by the tool.
Figure 6:
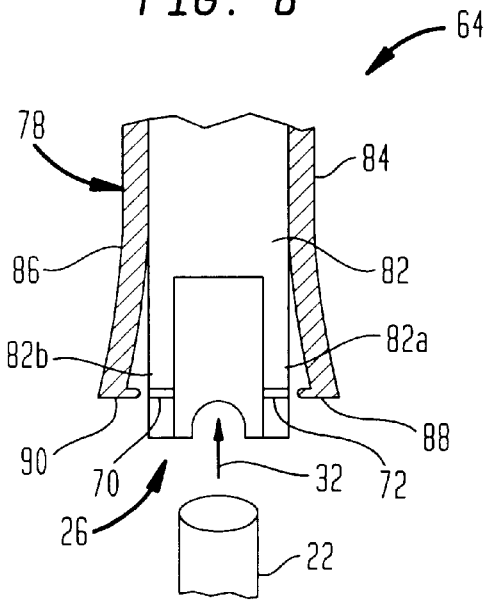
FIG. 6 is a side elevational view of an IDC cap removal tool according to the disclosure illustrating the cap and the IDC connection.

FIGS. 5 and 6 illustrate an IDC relief cap removal tool 78 having a head portion 80 supporting a center section 82 flanked by a pair or movable arms 84 and 86. Center section 82 has a width (W) that is equal to or greater than the width of the relief cap 26 as illustrated in FIG. 5. Arms 84 and 86 terminate or have thereon a pair of tangs 88 and 90 that are configured to fit within locking window 70 and 72 as illustrated in greater detail in FIGS. 7, 8 and 9.

In its normal condition, relief cap removal tool 78 may have its arms 84 and 86 biased outwardly as illustrated in FIG. 6. Force, for example a hand grip, exerted along lines 92 and 94 is used to move arms 84 and 86 into contact with center section 82 as illustrated in FIG. 5.

Figure 7:
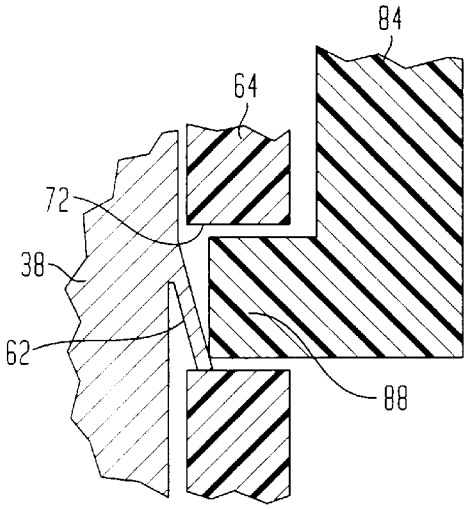
FIG. 7 is a fragmentary enlarged view illustrating removal of a relief cap from the connection.
Figure 8:
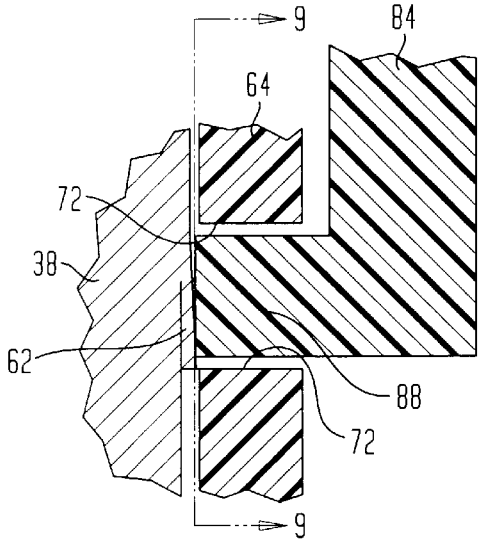
FIG. 8 is a view similar to FIG. 7 illustrating removal of a relief cap from the connection.
Figure 9:
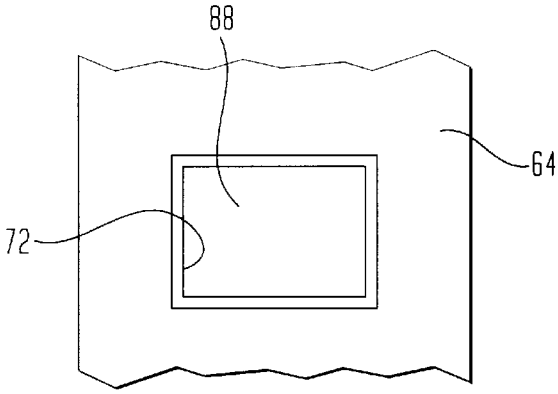
FIG. 9 is a view taken along line 9—9 of FIG. 8 illustrating a relationship between a locking window of the relief cap and a tang of the removal tool.

When relief cap removal tool 78 is located relative to a strain relief cap 26 as illustrated in FIG. 5 center section 82 may be configured to terminate at an end 96 that is configured for making contact with end 98 of strain relief cap 26. In this position, as illustrated in FIG. 5, tangs 88 and 90 are juxtaposition windows 72 and 70 for engagement therein as illustrated in part in FIG. 7. Further movements of arms 84 and 86 toward center section 82 by force 92 and 94 forces tangs 88 and 90 into contact with flexible tabs 62 and 60 as partially illustrated in FIGS. 7 and 8. When the arms 84 and 86 are in full contact with center section 82 as illustrated in FIG. 8, the end of tang 88 has fully forced flexible tab 62 out of locking window 72 whereby movement of tool 78 away from contact 22 will result in disengagement of arm 38 from locking window 72. Simultaneously with this action similar disengagement is occurring with tab 60 from locking window 70.

The width (W) of center section 82 along with the shape of arms 84 and 86 and the configuration of tangs 88 and 90 insure the proper location of the tangs 88 and 90 within the window 72 and 70 to insure flexible depression of tab 60 and 62 out of window 70 and 72 for disengagement of relief cap 26 from contact 22. Proper location is also achieved in the embodiment shown in FIG. 5 by the proper location of terminating end 96 of center section 82 relative to surface 98 of relief cap 26.

It should be appreciated other than square tangs 88 and 90 and matching locking windows 72 and 70 may be used. It is desired that the tangs be relatively close in configuration to the mating locking window to insure depression of the flexible tabs 60 and 62 with simultaneous gripping of the relief cap 26 for removal of the cap from the electrical contact 22. It should also be appreciated that relief cap removal tool 78 may have a center section 82 that covers the sides of relief cap 26 in the area of locking window 70 and 72. In these alternate embodiments the tangs 88 and 90 may project though openings in the side sections 82*a* and 82*b* of center section 82 or the side sections of center section 82 may terminate short of the locking window 70 and 72 for movement of the tangs directly into the windows as illustrated in FIGS. 7 and 8. In this latter arrangement, the tangs 88 and 90 will have to be long enough to extend through the side walls of relief cap 26 as well as the thickness of the side sections 82*a* and 82*b* extending from center section 82.

It should also be appreciated that the arms 84 and 86 need not terminate at tangs 88 and 90 but may extend beyond the tangs to further locate the arms 84 and 86 relative to the sides of relief cap 26 for insertion of the tangs 88 and 90 into windows 72 and 70. In this latter arrangement friction between the side walls 84 and 86 or other means may be used to grip relief cap 26 while tangs 88 and 90 depress flexible tabs 62 and 60 for removal of the relief cap 26 from contact 22.

As shown in FIG. 6, by releasing the force along lines 92 and 94 on arms 84 and 86 the arms are biased outwardly away from relief cap 26 removing tangs 88 and 90 respectfully from locking window 72 and 70. In this latter arrangement relief cap 26 may thereby be removed from tool 78.

It should also be appreciated that tool 78 may be first used to grip a relief cap 26 as illustrated in FIG. 5. The relief cap may then be manually located relative to contact 22 to assemble the IDC assembly as shown in FIG. 4. Upon full assembly, the force may be removed from lines 92 and 94 allowing arms 84 and 86 to be biased outwardly away from relief cap 26 as shown in FIG. 6 and allowing tabs 60 and 62 to engage windows 70 and 72 as shown in FIGS. 4 and 7. The tool 78 in this latter application allows for hand gripping of a relatively small relief cap and the application of force to install the relief cap onto a connector 22 as illustrated in FIG. 4. Tool 78 can accordingly be used for both assembly and disassembly and provide a relatively low cost easily usable tool for providing rapid assembly and disassembly of relief caps 26 relative to contacts 22.

What is claimed is:

1. An assembly for releasably connecting a wire comprising:

a. a protective block having a plurality of spaced, cylindrically shaped pins;

b. a metal IDC contact having (i) a first end having a hollow cylindrically shaped portion to engage one of said cylindrically shaped pins on said protective block to retain said IDC contact relative to said block, (ii) a second end defining a bifurcated end having (a) inwardly facing opposed surfaces having parallel opposed surfaces spaced relative to one another to make contact with a wire located between said inwardly facing opposed surfaces, and angularly spaced opposed surfaces diverging away from said parallel surfaces, (b) a curved surface opposite said angularly spaced opposed surfaces and contacting said parallel surfaces to define a terminal portion of said bifurcated end, (c) parallel outwardly facing opposed surfaces, (d) flat side surfaces parallel to one another, and (e) end surfaces opposite said terminal portion to define an opening within said bifurcated end to receive said wire, and (iii) a flexible tab on each of said parallel outwardly facing opposed surfaces defined in part by said flat side surfaces, said tabs extending outwardly a distance away from said parallel outwardly facing surfaces;

c. a box shaped relief cap having (i) surfaces defining a cavity to receive said bifurcated end, said defining surfaces of said cavity including (a) parallel inwardly facing opposed surfaces spaced apart a distance slightly greater than the parallel outwardly facing opposed surfaces of said bifurcated end and less than the distance the outwardly extending portions of said tabs to flex said tabs towards said outwardly facing surfaces when said bifurcated end is moved within said cavity, (b) flat side surfaces parallel to one another and spaced apart a distance slightly greater than said flat side surfaces of said bifurcated end, and (c) an end surface enclosing said cavity at one end within said cap;

(ii) a curved surface at the open end of said cavity shaped to engage a wire and parallel to said parallel inwardly facing opposed surfaces defining said cavity; and (iii) locking windows opening into said parallel inwardly facing opposed surfaces defining said cavity and the exterior of said strain relief cap, said windows being in alignment with said flexible tabs when said bifurcated end is located within said cavity of said strain relief cap and a wire is located between said inwardly facing parallel opposed surfaces of said bifurcated end and in contact with said curved surface of said cap and said curved surface of said bifurcated end whereby said tabs flex outwardly into said locking windows to retain said bifurcated end relative to said strain relief cap; and d. a tool having (i) a pair of movable spaced arms that may be located juxtaposition to said locking windows, and (ii) a pair of tangs secured to and movable with said arms and each shaped for insertion into one of said locking windows for engagement with said flexible tab in said locking window, whereby said tabs may be moved with said arms into said windows to depress said tabs out of said windows and grip said relief cap for removal of said relief cap from said second end.

2. An assembly according to claim 1 wherein;

a. said locking windows have a given cross sectional configuration between said parallel inwardly facing opposed surfaces and the exterior of said strain relief cap;

b. said arm are engageable with the sides of the exterior of said relief cap in the area of said locking window; and c. said tangs have a cross sectional configuration similar to said cross sectional configuration of said locking windows and extend a distance that is equal to or greater than the distance between said exterior of said relief cap and said parallel inwardly facing opposed surfaces of said relief cap to engage said relief cap through said locking windows and depress said flexible tabs to a position whereby said relief cap may be removed from said second end.

3. A tool to disassemble an IDC strain relief cap assembly used to interconnect a wire with an electrical contact, wherein the assembly includes an IDC contact having a first end, means to engage and make electrical contact between said first end and said electrical contact, a second end, and means to engage and make electrical contact between said wire and said second end; a strain relief cap having means to releasably retain said strain relief cap relative to said second end of said IDC contact, said tool comprising:

a. a pair of movable spaced arms that may be located juxtaposition to said strain relief cap; and b. gripping means secured to and movable with said pair of arms into contact with said retaining means to release said retaining means and to grip said strain relief cap whereby said strain relief cap may be removed from said second end of said IDC contact with said tool.

4. A tool according to claim 3 wherein said means to engage and make electrical contact between said wire and said second end is a bifurcated end on said second end having spaced arms with inwardly facing opposed surfaces to make contact with each side of a wire located between said inwardly facing opposed surfaces; said bifurcated end further comprises angularly spaced opposed surfaces diverging away from said inwardly facing surfaces, and a curved surface opposite said angularly spaced opposed surfaces and contacting said inwardly facing surfaces to define a terminal portion of said bifurcated end to receive and contact a portion of said wire; said strain relief cap is an open-ended box shaped relief member having surfaces defining a cavity to receive said bifurcated end, and a curved surface at the open end of said cavity extending in a direction that is in between and at a right angle to said inwardly facing surfaces of said bifurcated end to receive and contact said wire; said means to retain said strain relief cap relative to said second end of said IDC contact comprises a flexible tab on each arm of said bifurcated end extending outwardly a distance away from said arms toward said surfaces defining said cavity, and locking window openings in said cap opening into said cavity and the exterior of said strain relief cap, said windows being in alignment with said flexible tabs when said bifurcated end is located within said cavity of said cap and a wire is located between said inwardly facing opposed surfaces of said bifurcated end and in contact with said curved surface of said strain relief cap and said curved surface of said bifurcated end whereby said tabs flex outwardly into said locking window to releasably retain said bifurcated end relative to said cap; and wherein said arms of said tool:

a. are spaced to be in relative close proximity to the sides of said cap; and b. said gripping means are a pair of tangs, each located on one of said arms for insertion into said locking windows to engage said flexible tabs for movement out of said locking windows to release said flexible tabs from said locking windows and engage said locking windows and thereby said strain relief cap for movement of said cap away from said second end.

* * * * *